US008764163B2

(12) United States Patent
Muraki

(10) Patent No.: US 8,764,163 B2
(45) **Date of Patent: *Jul. 1, 2014**

(54) INKJET RECORDING DEVICE HAVING WASTE LIQUID CHAMBER

(75) Inventor: Motohito Muraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 94 days.

This patent is subject to a terminal disclaimer.

(21) Appl. No.: 13/433,229

(22) Filed: Mar. 28, 2012

(65) Prior Publication Data

US 2013/0063521 A1 Mar. 14, 2013

(30) Foreign Application Priority Data

Sep. 9, 2011 (JP) ..... 2011-197171

(51) Int. Cl.
*B41J 2/165* (2006.01)

(52) U.S. Cl.
USPC ..... 347/36

(58) Field of Classification Search
USPC ..... 347/22–36
See application file for complete search history.

(56) References Cited

U.S. PATENT DOCUMENTS

| | | | | |
|---|---|---|---|---|
| 2005/0151782 | A1 | 7/2005 | Ishida et al. | |
| 2005/0195241 | A1 | 9/2005 | Kawai et al. | |
| 2008/0030530 | A1 | 2/2008 | Ishida et al. | |
| 2008/0106572 | A1 * | 5/2008 | Yoshino et al. | 347/36 |
| 2008/0129777 | A1 | 6/2008 | Watanabe | |
| 2010/0165040 | A1 * | 7/2010 | Ohnishi et al. | 347/36 |

FOREIGN PATENT DOCUMENTS

| | | | |
|---|---|---|---|
| JP | 2003-289406 | A | 10/2003 |
| JP | 2003-298790 | A | 10/2003 |
| JP | 2006-027040 | A | 2/2006 |
| JP | 2006-035662 | A | 2/2006 |
| JP | 2008-137349 | A | 6/2008 |
| JP | 2009-262446 | A | 11/2009 |

* cited by examiner

*Primary Examiner* — Justin Seo
(74) *Attorney, Agent, or Firm* — Baker Botts L.L.P.

(57) ABSTRACT

An inkjet recording device includes a main body and a movable unit. The main body includes a recording head and a pump. The recording head is configured to eject ink onto a recording medium to record an image. The pump is configured to draw the ink from the recording head. The movable unit is configured to move between a near position and a far position where is away from the near position with respect to the main body. The movable unit includes a waste liquid chamber configured to accommodate the ink drawn by the pump.

8 Claims, 10 Drawing Sheets

10
12
54
11
TOP
BOTTOM
7
FRONT
REAR
8
93
12
24
38
44
65
64
71
93
37
43
61
68
73
67

LEFT
TOP
RIGHT
BOTTOM
LEFT
TOP
RIGHT
BOTTOM
24
37
38
36
57A
56A
56(74)
79
111
78
72
58
51
113
112
60 (74)
57 (74)
24
38
39
40
57A
57(74)
60(74)
56(74)
111
79
78
72
51
113
112

INKJET RECORDING DEVICE HAVING WASTE LIQUID CHAMBER

CROSS REFERENCE TO RELATED APPLICATION

This application claims priority from Japanese Patent Application No. 2011-197171 filed Sep. 9, 2011. The entire content of this priority application is incorporated herein by reference.

TECHNICAL FIELD

The present invention relates to an inkjet recording device including a recording head for ejecting ink onto a recording medium to form an image on the recording medium and a pump for drawing the ink from the recording head.

BACKGROUND

In a conventional inkjet recording device, an ink droplet is ejected onto a conveyed recording medium to form an image thereon. The inkjet recording device includes a recording head and a purge mechanism. The purge mechanism draws ink from nozzles of the recording head to remove the ink together with foreign materials in the nozzles. The purge mechanism is provided with a waste liquid chamber for accommodating the drawn ink.

SUMMARY

Japanese Patent Application Publication No. 2009-262446 discloses a printer including a head as a recording head, a maintenance unit as a purge mechanism, and a waste ink tank as a waste liquid chamber.

The waste ink tank is disposed diagonally upward and forward relative to the head.

To accommodate sufficient amount of ink, the waste ink tank has a larger volume than the head. However, this configuration enlarges the size of waste ink tank in the front-to-rear direction and right-to-left direction, resulting in a large installation area of the printer.

In view of the foregoing, it is an object of the invention to provide a compact inkjet recording device.

In order to attain the above and other objects, the present invention provides an inkjet recording device. The inkjet recording device includes a main body and a movable unit. The main body includes a recording head and a pump. The recording head is configured to eject ink onto a recording medium to record an image. The pump is configured to draw the ink from the recording head. The movable unit is configured to move between a near position and a far position where is away from the near position with respect to the main body. The movable unit includes a waste liquid chamber configured to accommodate the ink drawn by the pump.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1A:
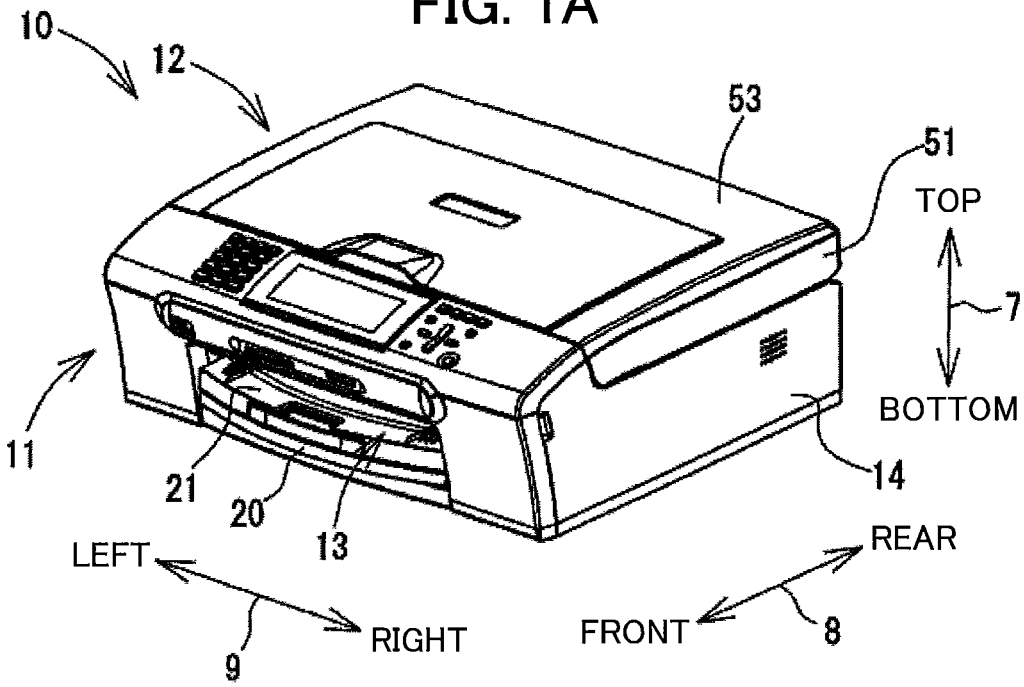
FIG. 1A is a perspective view of a multifunction device according to an embodiment of the present invention.

A multifunction device 10 as an example of an inkjet recording device according to embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the multifunction device 10 is disposed in a posture in which it is intended to be used. In use, the multifunction device is disposed as shown in FIG. 1A.

[Multifunction Device 10]

As shown in FIG. 1A, the multifunction device 10 is of a substantial thin rectangular parallelepiped shape. The multifunction device 10 has an upper portion provided with a scanner section 12 scanning an image on a document by an image sensor to acquire image data, and a lower portion provided with a print section 11 forming the scanned image on a recording sheet 15.

The scanner section 12 includes a scanner casing 51 having a roughly rectangular parallelepiped shape, a document cover 53 pivotally movably connected to an upper surface of the scanner casing 51, a platen glass (not shown) on which the document is rested, and an image sensor (not shown) for reading the document on the platen glass. The scanner section 12 is configured of a flatbed type scanner. The document cover 53 is pivotally movable about a rear portion thereof, i.e., about a shaft 54 extending in a right-to-left direction 9 shown in FIG. 4A, between a first posture in which the platen glass is covered with the cover 53 as shown in FIG. 1A and a second posture in which the platen glass is exposed to outside. The document can be set on the platen glass while the document cover 53 is at the second posture. The scanner casing 51 is also pivotally movable relative to the printer casing 14, and detailed structure of this movement will be described later. The platen glass and the image sensor are accommodated in the scanner casing 51. The platen glass is disposed below the document cover 53.

Figure 2:
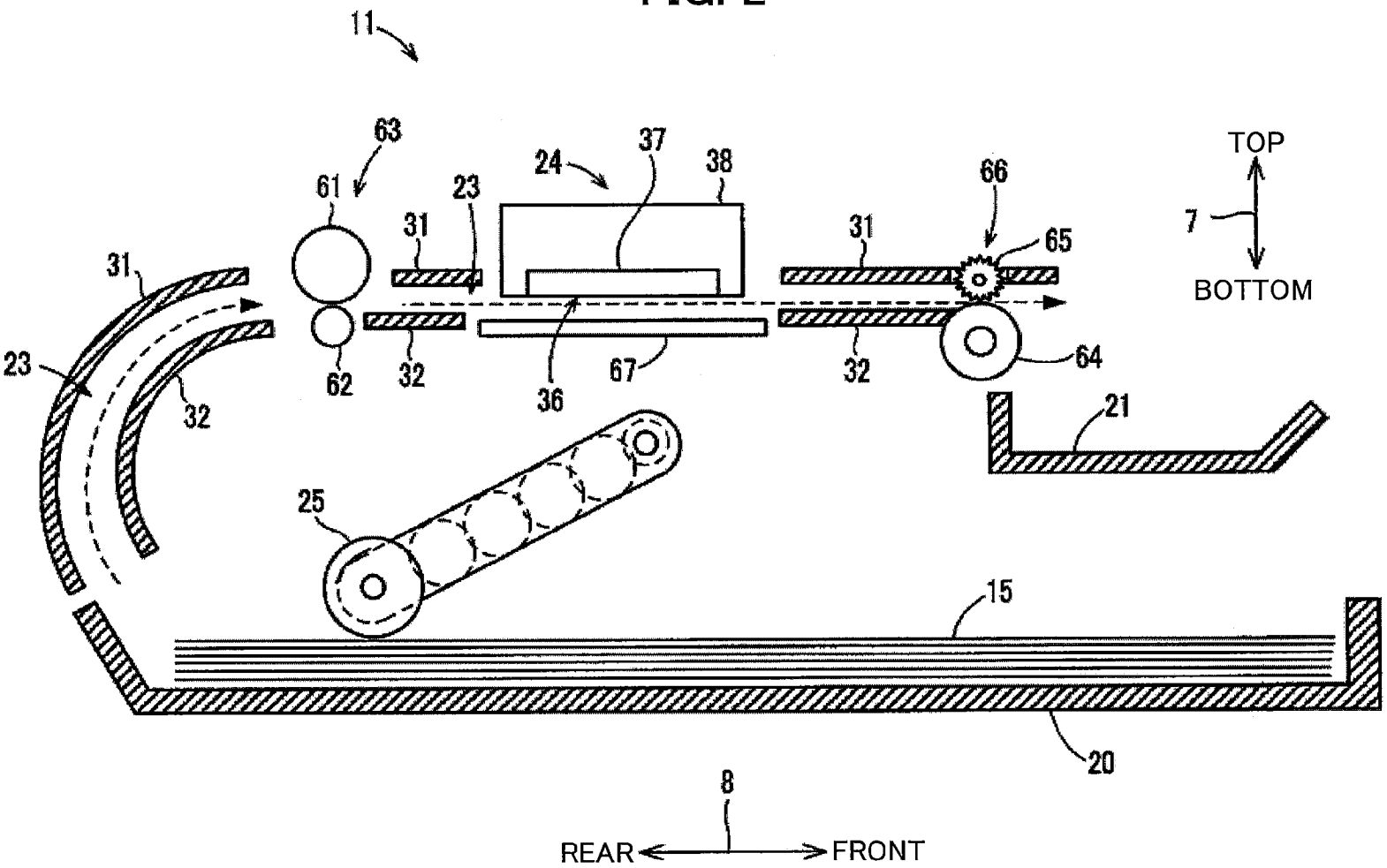
FIG. 2 is a schematic cross-sectional view of an internal structure of the multifunction device.

The print section 11 includes a printer casing 14 formed with a front opening 13 through which a supply tray 20 and a discharge tray 21 are insertable as shown in FIG. 1A, a primary frame 26 (FIG. 3) having a pair of guide rails 43, 44, and a secondary frame 68 (FIG. 7) provided within the printer casing 14. The supply tray 20 accommodates a stack of recording sheets 15 having a prescribe size. As shown in FIG. 2, the print section 11 further includes a sheet supply roller 25 for supplying the recording sheet 15 accommodated in the supply tray 20 to the conveying path 23, a pair of conveying rollers 63 and a pair of discharge rollers 66 located on the conveying path 23 for conveying the recording sheet 15 supplied by the sheet supply roller 25, and a recording section 24 for forming an image on the recording sheet 15 based on image data obtained by scanning the document by the scanner section 12. The print section 11A defines a conveying path 23 for guiding the recording sheet 15.

[Conveying Path 23]

As shown in FIG. 2, the conveying path 23 extends from a rear end portion of the supply tray 20 to the discharge tray 21 passing through a U-shaped curved path and below the recording section 24. The conveying path 23 is defined between a first guide member 31 and a second guide member 32 apart from and in confrontation with the first guide member 31. The recording sheet 15 is conveyed along the conveying path 23 in a feeding direction depicted by a dotted arrow in FIG. 2.

[A Pair of Conveying Rollers 63 and a Pair of Discharge Rollers 66]

The pair of conveying rollers 63 are disposed on the conveying path 23 upstream of the recording section 24 in the feeding direction and configured of a conveying roller 61 and a pinch roller 62. The pinch roller 62 is in pressure contact with a circumferential surface of the conveying roller 61 by an urging member such as a spring (not shown), allowing the pair of conveying rollers 63 to nip the recording sheet 15.

The pair of discharge rollers 66 are disposed on the conveying path 23 downstream of the recording section 24 in the feeding direction and configured of a discharge roller 64 and a wheel 65. The wheel 65 is in pressure contact with a circumferential surface of the discharge roller 64 by an urging member such as a spring (not shown), allowing the pair of discharge rollers 66 to nip the recording sheet 15.

The conveying roller 61 and the discharge roller 64 are driven by a rotational driving force transmitted from a motor (not shown) through a transmission mechanism (not shown) configured of planetary gears. The conveying roller 61 and the discharge roller 64 nip the recording sheet 15 respectively in cooperation with the pinch roller 62 and the wheel 65 for feeding the recording sheet 15 in the feeding direction.

[Recording Section 24]

As shown in FIGS. 2 to 5B, the recording section 24 is disposed on the conveying path 23. The recording section 24 is provided with an inkjet type recording head 37 and a carriage 38 carrying the recording head 37. The carriage 38 is reciprocally movably supported on the pair of guide rails 43, 44 in the right-to-left direction 9 orthogonal to the feeding direction (front-to-rear direction 8).

The recording head 37 is disposed beneath the carriage 38. The recording head 37 has a bottom surface (hereinafter referred to as "nozzle surface 36") formed with a plurality of nozzles (not shown) exposed to an outside, as shown in FIG. 10.

The print section 11 has a right front portion provided with an ink tank (not shown) of each color. Each color of ink accommodated in the ink tank is supplied to the recording head 37, and is ejected from each nozzle in the form of a small ink droplet during the reciprocally movement of the carriage 38, forming the image on the recording sheet 15 conveyed on a platen 67 described below.

[Platen 67]

As shown in FIGS. 2 to 5B, the platen 67 is disposed immediately below the recording head 37 of the recording section 24 and is supported on the primary frame 26 at its lateral ends in the right-to-left direction 9. The platen 67 has an upper surface in confrontation with the nozzle surface 36. The platen 67 is of generally rectangular plate shape having a longitudinal length in the front-to-rear direction 8 and a widthwise length in the right-to-left direction 9, these length being longer than a height thereof in a top-to-bottom direction 7. The widthwise length of the platen 67 is longer than the longitudinal length of the same. The upper surface of the platen 67 supports the recording sheet 15 conveyed in the conveying path 23.

[Purge Mechanism 69]

Figure 9:
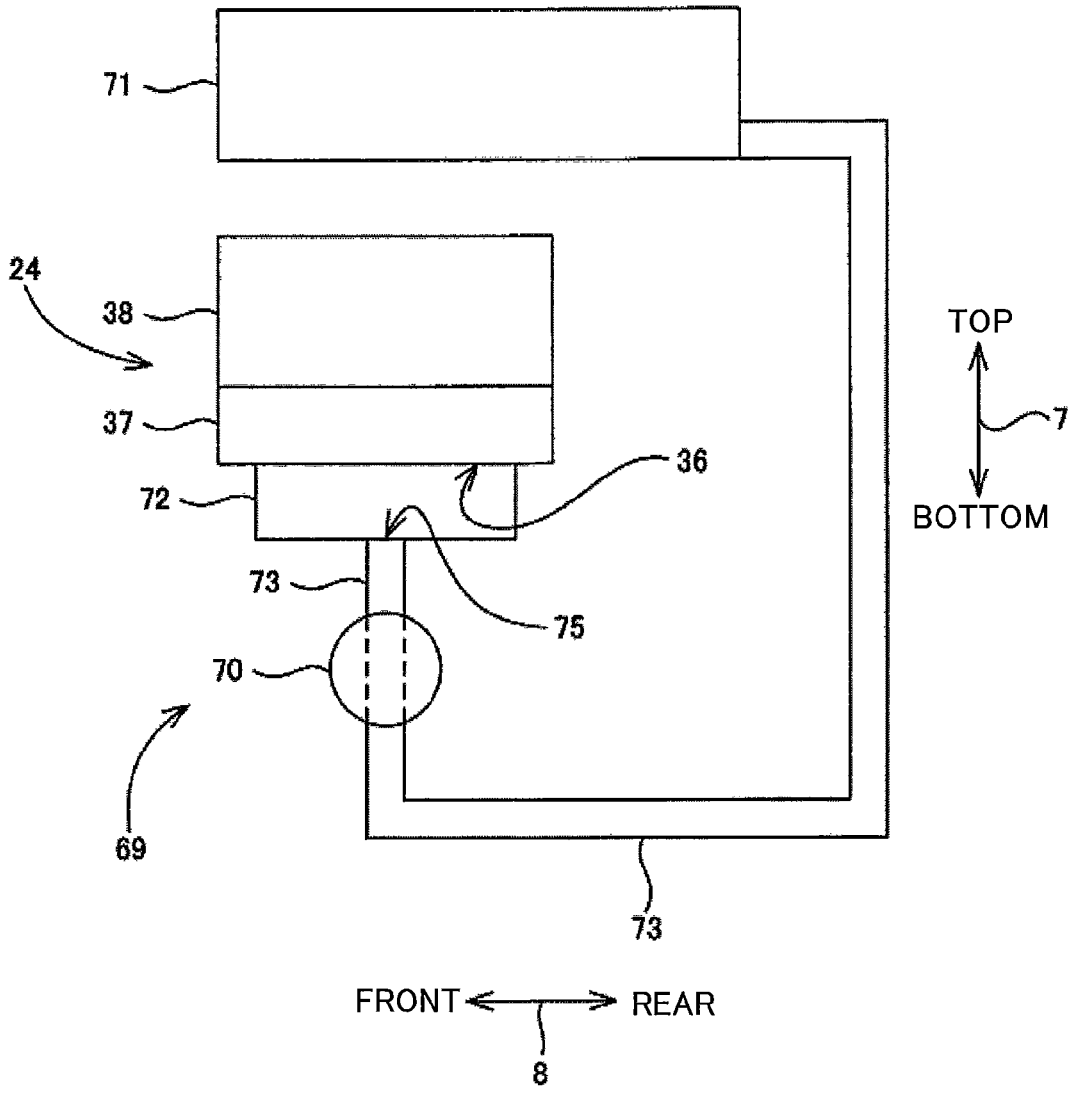
FIG. 9 is a schematic right side view of the waste liquid chamber, a recording section, and a purge mechanism in the multifunction device.

A purge mechanism 69 is provided in the printer casing 14 as shown in FIG. 9, and is adapted to draw ink together with air bubbles and foreign materials from the recording head 37. The purge mechanism 69 includes a cap 72 covering the nozzles of the recording head 37, a pump 70 connected to the cap 72 for drawing ink from the recording head 37, a lift-up mechanism 74 (FIG. 10) that moves the cap 72 in the top-to-bottom direction 7 so as to be in contact with and away from the recording head 37, and a pump tube 73 for connecting the pump 70 with a waste liquid chamber 71 described later.

[Cap 72]

Figure 3:
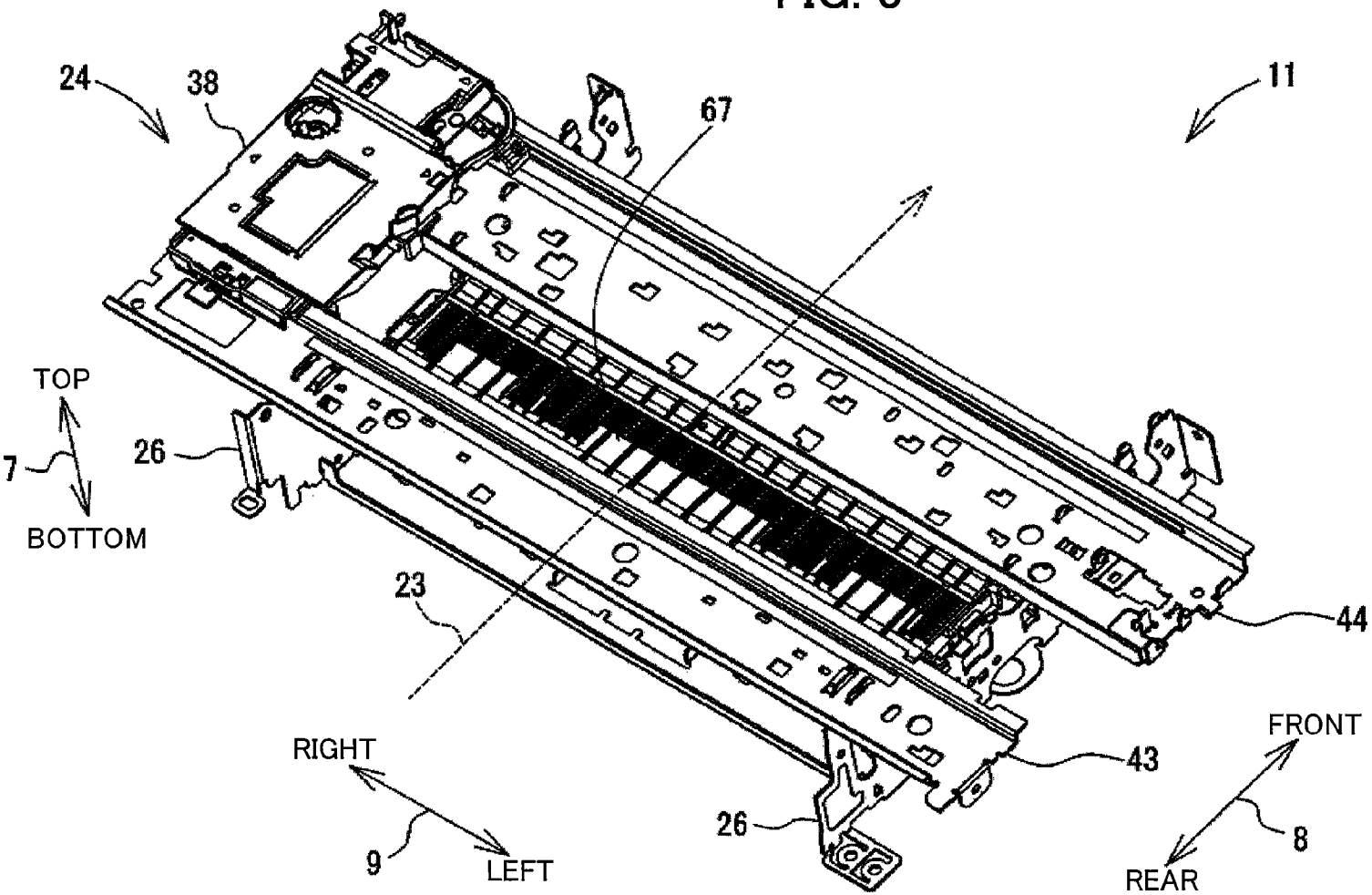
FIG. 3 is a perspective view of the internal structure of the multifunction device as viewed from diagonally left and above.

The cap 72 is disposed offset from a recording sheet passage region in the conveying path 23 in the right-to-left direction 9, i.e., the cap 72 is disposed at a retreated position away from the reciprocally movable range of the carriage 38. FIG. 3 shows a state where the carriage 38 is positioned at the retreated position. As shown in FIG. 9, the cap 72 is located below the recording section 24 when the carriage 38 is moved to the retreated position.

The cap 72 is made of elastic materials such as rubber. The cap 72 is adapted to be in hermetical contact with the nozzle surface 36 by the lift-up mechanism 74 to form a gap therebetween and cover the nozzles. The cap 72 has a bottom surface formed with an inlet 75 connected to the pump 70 and the waste liquid chamber 71 via the pump tube 73.

[Pump 70]

As shown in FIG. 9, the pump 70 is in fluid communication with the cap 72 via the pump tube 73. The pump 70 is a rotary type tube pump. In the embodiment, the pump 70 includes a casing having an inner wall and a rotation roller rolling along the inner wall. The pump tube 73 is disposed between the rotation roller and the inner wall. Upon rotating the rotation roller, the ink in the pump tube 73 flows from an upstream side (cap 72) to a downstream side (waste liquid chamber 71) in an ink flowing direction.

[Lift-Up Mechanism 74]

Figures 10A, 10B:
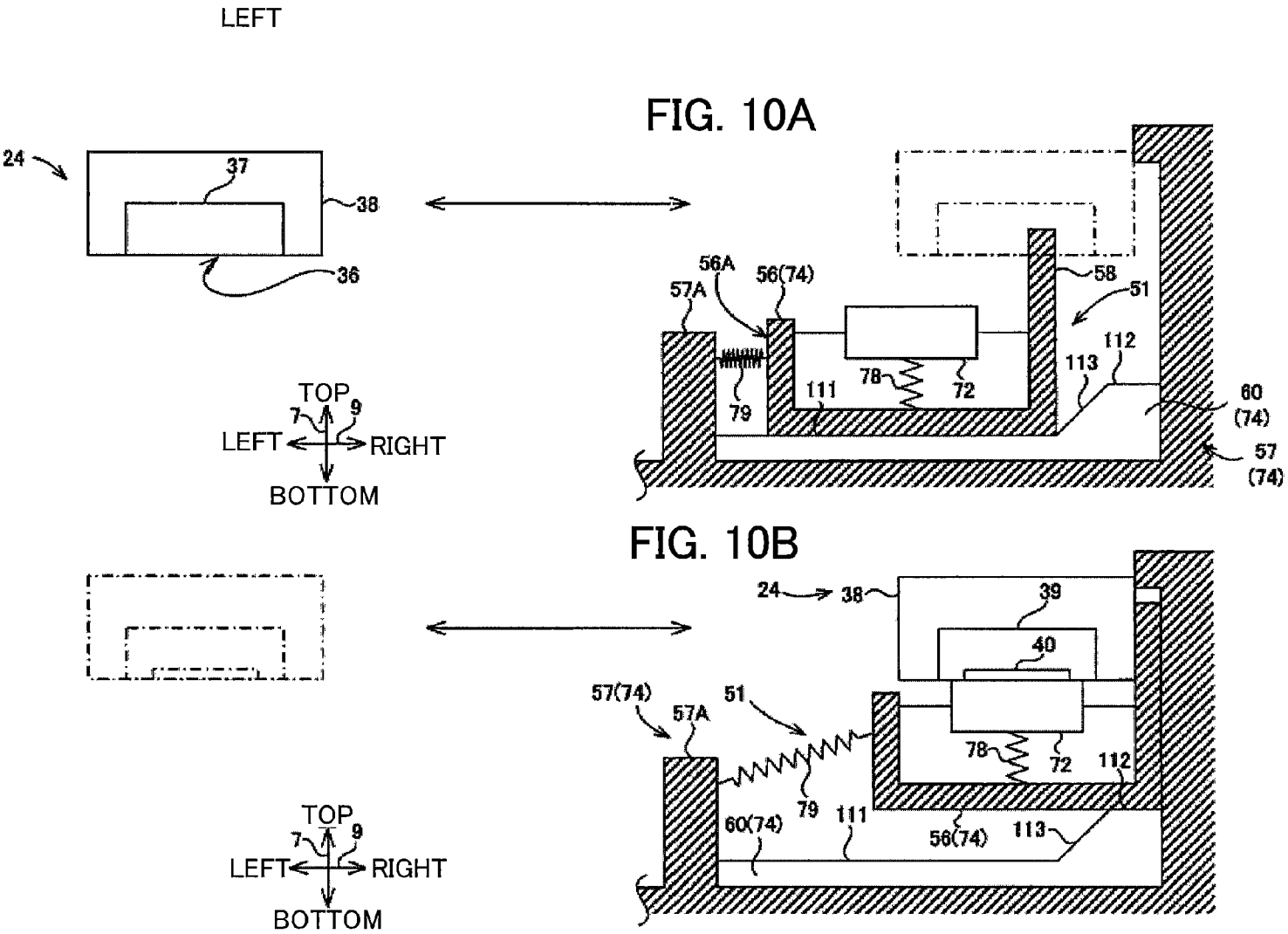
FIG. 10A is a schematic cross-sectional view of a lift-up mechanism when a cap is at a fourth posture in the multifunction device.
FIG. 10B is a schematic cross-sectional view of the lift-up mechanism when the cap is at a third posture in the multifunction device.

The lift-up mechanism 74 is provided with a first frame 56, a second frame 57, and a slide cam 60 as shown in FIGS. 10A and 10B. The depiction of the lift-up mechanism 74 is omitted in the drawings other than FIG. 10. The lift-up mechanism 74 is not limited to the following configuration as long as the lift-up mechanism 74 vertically lifts up the cap 72.

The first frame 56 has a box shape slidably supported on the slide cam 60. The slide cam 60 is supported on the second frame 57. The second frame 57 is fixed to the secondary frame 68, or may be a part of the secondary frame 68. The slide cam 60 has a guide surface with which a bottom surface of the first frame 56 is slidingly contactable. The guide surface includes a first guide surface 111 disposed at a lower position, a second guide surface 112 disposed at a higher position, and a slope surface 113 connecting the first guide surface 111 with the second guide surface 112.

The first frame 56 is slidingly movable in the right-to-left direction 9 while being supported on the first guide surface 111, the second guide surface 112, and the slope surface 113. The first frame 56 slidingly moves in the right-to-left direction 9 and simultaneously moves in the top-to-bottom direction 7 by means of a support of the slope surface 113.

The first frame 56 has a right end portion provided with a lever 58 upstanding from a bottom surface thereof. The lever 58 has a top end portion overlapped with a moving region of the carriage 38.

The cap 72 covers the nozzle of the recording head 37 disposed at a position, as depicted by chain-line in FIG. 10A, immediately above the purge mechanism 69 (FIG. 10B). In the embodiment, the cap 72 is supported on the first frame 56 and resiliently movable in the top-to-bottom direction 7 via a first coil spring 78 disposed between an inner bottom surface of the first frame 56 and the bottom surface of the cap 72.

Upon being supported on the first guide surface 111, the cap 72 has a fourth posture in which the nozzle surface 36 of the recording head 37 separates from the cap 72 as shown in FIG. 10A. Upon being supported on the second guide surface 112, the cap 72 has a third posture in which the nozzle surface 36 of the recording head 37 is in contact with and covered with the cap 72 as shown in FIG. 10B.

The second frame 57 is provided with a protrusion 57A protruding upward. A second coil spring 79 is interposed between a left surface 56A of the first frame 56 and the protrusion 57A. The second coil spring 79 is at its natural length when the first frame 56 is supported on the first guide surface 111, i.e., the cap 72 has the fourth posture as shown in FIG. 10A, whereas the second coil spring 79 is at its extending state when the first frame 56 is supported on the second guide surface 112, i.e., the cap 72 has the third posture as shown in FIG. 10B. That is, the second coil spring 79 is a tension spring that resiliently urges the cap 72 toward the fourth posture.

In the state shown in FIG. 10A, the carriage 38 reciprocally moves to the purge mechanism 69 side (rightward) and then is brought into contact with the lever 58 to push the lever 58 rightward. Thus, the first frame 56 slidingly moves rightward against a resilient force of the second coil spring 79.

The first frame 56 is moved along the guide surface and displaced diagonally rightward and upward, while the first frame 56 is supported successively on the first guide surface 111, on the slope surface 113, and then on the second guide surface 112 in this order, so that the cap 72 changes its posture from the fourth posture to the third posture.

[Drawing Ink]

An ink drawing (suction) procedure executed by the purge mechanism 69 will be described. As shown in FIGS. 10A and 10B, the cap 72 changes its posture from the fourth posture to the third posture by means of the lift-up mechanism 74. Then, the recording head 37 is covered with the cap 72. Next, the pump 70 is activated for drawing ink from the nozzles through the gap between the nozzle surface 36 and the cap 72. Consequently, the ink drawn by the pump 70 flows to the waste liquid chamber 71 via the pump tube 73.

[Waste Liquid Chamber 71]

The waste liquid chamber 71 is provided at the scanner casing 51 and adapted to accommodate the ink drawn by the pump 70. As the following description, top-to-bottom direction 7, front-to-rear direction 8, and right-to-left direction 9 are used herein to define the various parts when the waste liquid chamber 71 is disposed in an orientation shown in FIG. 6A.

Figure 7:
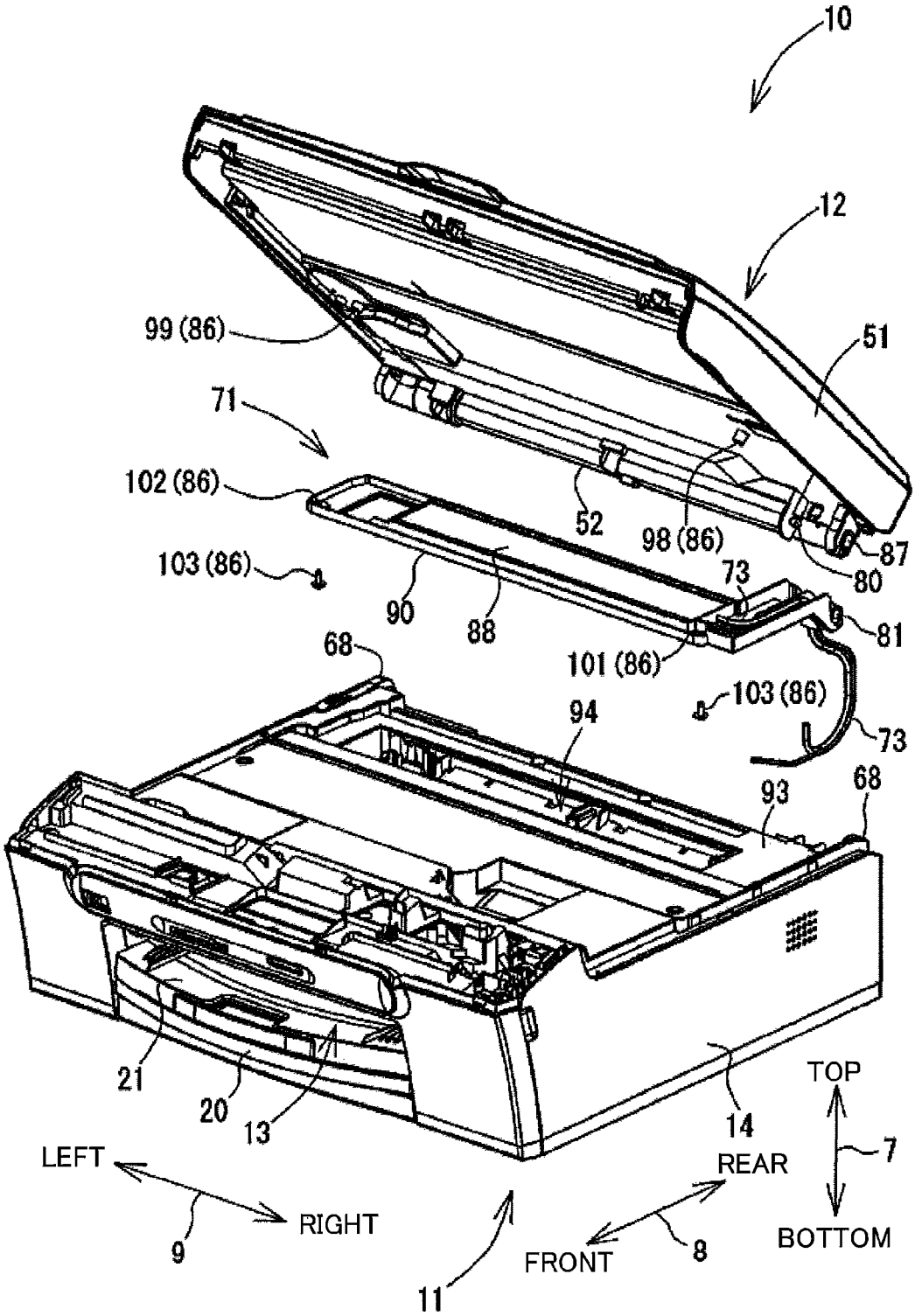
FIG. 7 is an exploded perspective view of the multifunction device in a state shown in FIG. 6A.
Figure 8:
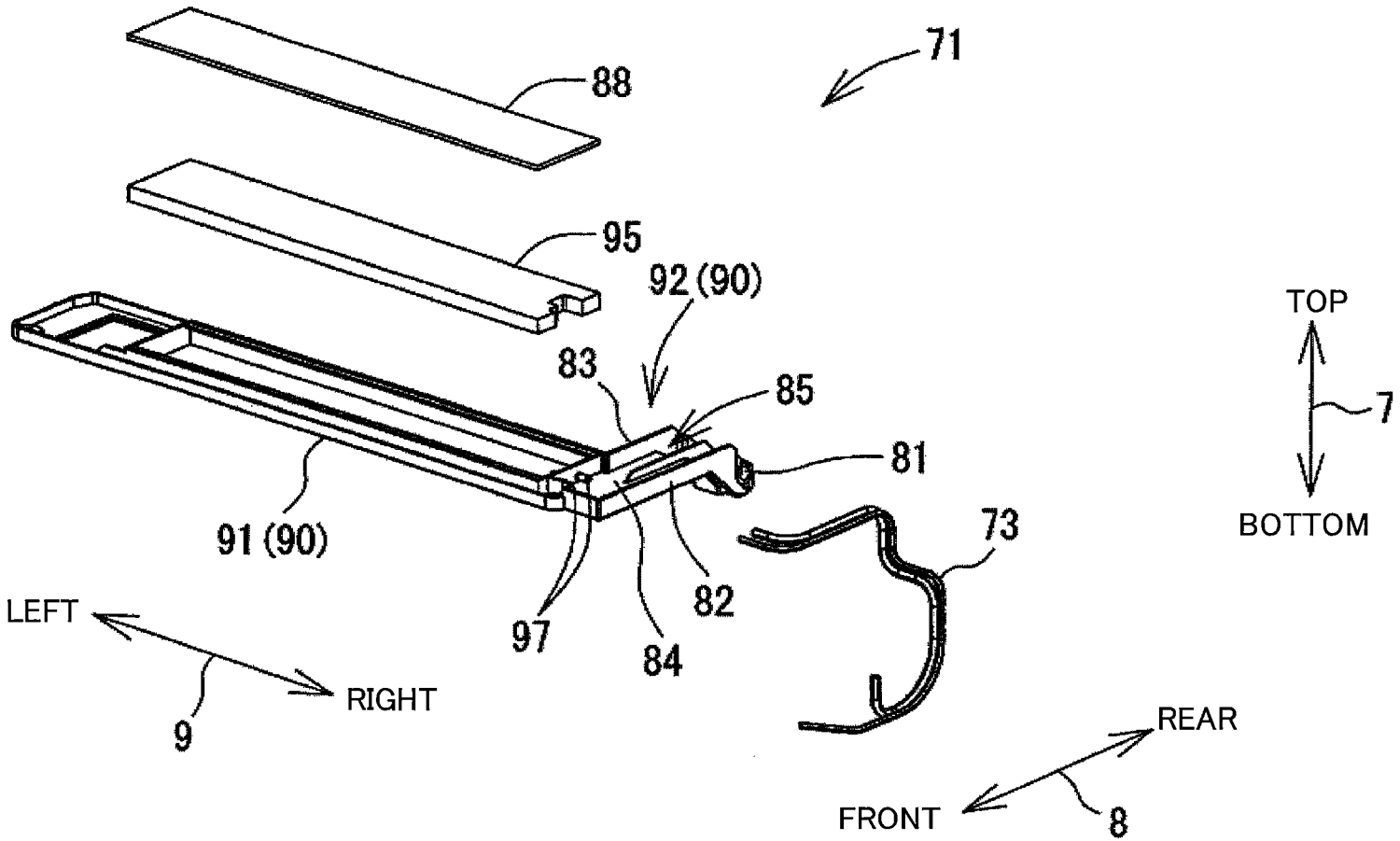
FIG. 8 is an exploded perspective view of the waste liquid chamber.

As shown in FIGS. 7 and 8, the waste liquid chamber 71 is provided with a main body 90 having generally L-shape in plan view, an ink absorbing member 95 provided in the main body 90, and a cover 88 covering the ink absorbing member 95. The cover 88 and an exposed part of the main body 90 are painted with deep color, such as black or deep blue.

As shown in FIG. 8, the main body 90 includes a first main body 91 configured of longitudinal part of L-shape extending in right-to-left direction 9 and a second main body 92 configured of lateral part of L-shape extending in front-to-rear direction 8. The detailed configuration of the first main body 91 and the second main body 92 will be described later.

The waste liquid chamber 71 has a front portion supported on a first cover 93 described later and a rear end portion pivotably supported on the secondary frame 68 as shown in FIG. 7.

Figure 6A:
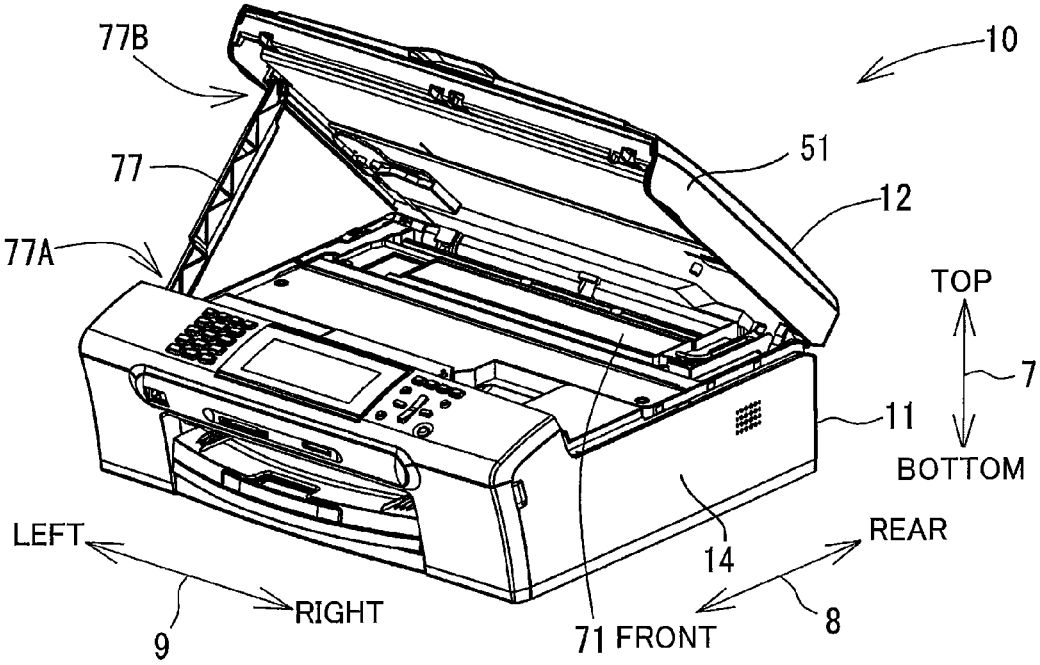
FIG. 6A is a perspective view of the multifunction device when the scanner casing is positioned at the fourth position and a waste liquid chamber of the multifunction device is positioned at a first position.

The waste liquid chamber 71 is positioned above the platen 67 in a state shown in FIG. 6A. That is, the waste liquid chamber 71 covers the conveying path 23 passing above the platen 67. In this state, it is troublesome for a user to remove the recording sheet 15 jammed at the platen 67. In the embodiment, the waste liquid chamber 71 is pivotally movable. When the recording sheet 15 is jammed at the platen 67, the user pivotally moves the waste liquid chamber 71 from a state shown in FIG. 6A to a state shown in FIG. 6B. By this pivotal movement, the conveying path 23 above the platen 67 is exposed to outside, allowing the user to easily remove the jammed recording sheet 15 on the platen 67.

The first main body 91 has a box shape with the top portion open as shown in FIG. 8. The first main body 91 accommodates the ink absorbing member 95 inserted from above. The first main body 91 has a front right end portion formed with a hole 101 (FIG. 7), a front left end portion formed with a hole 102 (FIG. 7), and a right wall provided with a connector 97 (FIG. 8) to which the pump tube 73 is connected. The ink absorbing member 95 is made of porous material such as foamed polyurethane. The ink flows into void formed in the porous material, thereby being absorbed in the ink absorbing member 95.

The ink flowing from the connector 97 into the waste liquid chamber 71 is absorbed into the ink absorbing member 95 and spreading leftward. The ink absorbing member 95 is exchangeably mounted in the first main body 91. The ink absorbing member 95 is replaced with a new one when the ink absorbed in the ink absorbing member 95 exceeds an acceptable amount.

The second main body 92 protrudes rearward from a right end portion of the first main body 91. The second main body 92 includes a right plate 82, a left plate 83, and a bottom plate 84 those defining a groove 85. As shown in FIGS. 7 and 8, the right plate 82 has a rear end portion formed with a through hole 81, and the left plate 83 has a rear end portion formed with a through hole (not shown) aligned with the through hole 81 in the right-to-left direction 9.

As shown in FIGS. 8 and 9, the pump tube 73 extends downward from the bottom surface of the cap 72, bends at a position adjacent to a bottom surface of the print section 11, rearward, bends at a position beneath a rear end portion of the second main body 92, upward, passes through the groove 85 of the second main body 92, and is connected to the connector 97.

The groove 85 passes between the through hole 81 of the right plate 82 and the through hole of the left plate 83. That is, the groove 85 is formed in a space ambient to the through hole 81. A pivot shaft of the waste liquid chamber 71 is inserted into the through hole 81 described later. The pump tube 73 extends along the groove 85 and passes at a position adjacent to an axis of the pivot shaft.

The connector 97 is constituted by two protrusions protruding rightward from the right wall of the first main body 91 and is formed with a hole. This hole extends through a length of the connector 97 and is in fluid communication with an inner space of the first main body 91. The pump tube 73 is connected to the connector 97. The ink drawn from the nozzles by the pump 70 is introduced into the waste liquid chamber 71 via the pump tube 73. The pump tube 73 provides a fluid communication between the waste liquid chamber 71 and the pump tube 73. The main body 90 holds the ink absorbing member 95 and the connector 97.

[First Cover 93]

Figures 4A, 4B:
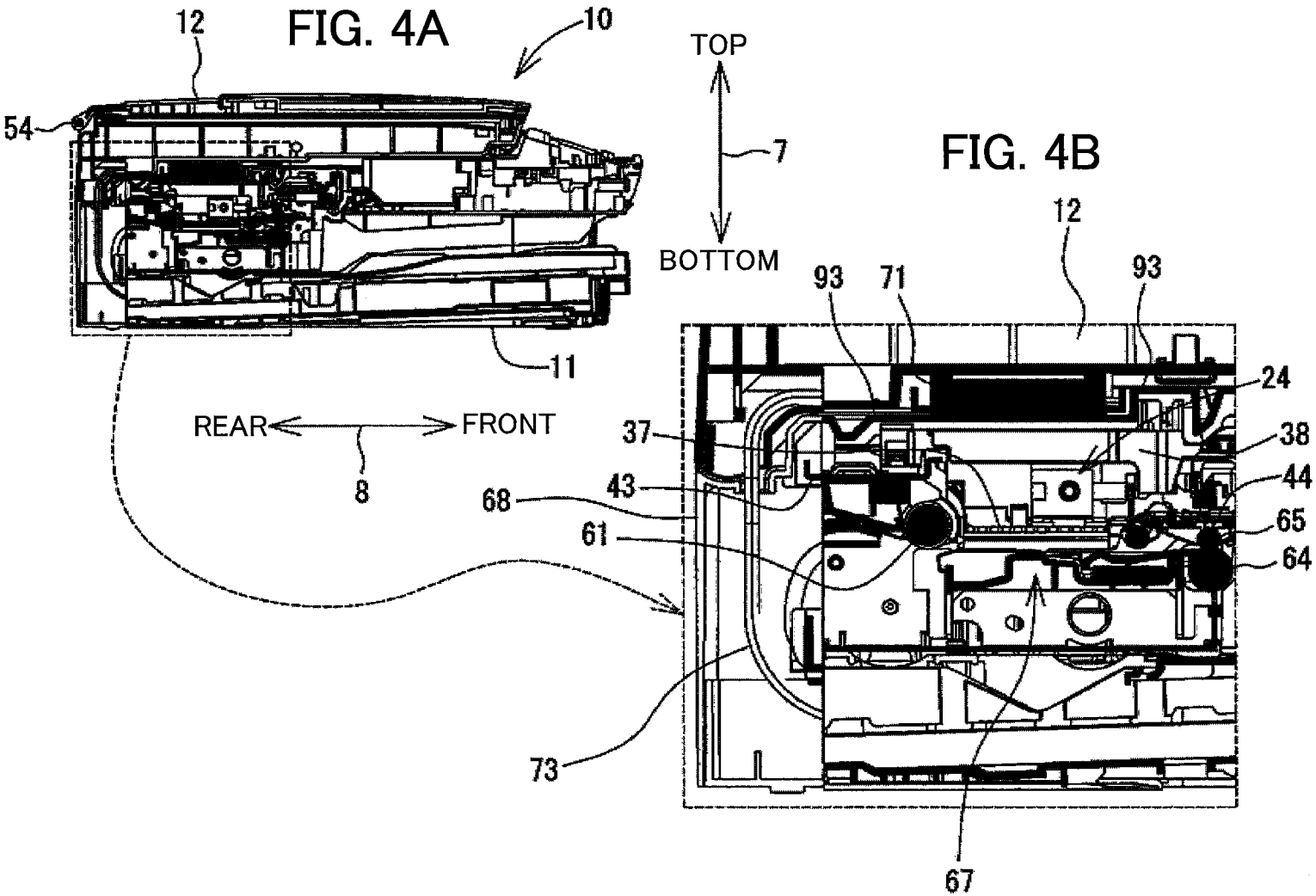
FIG. 4A is a side cross-sectional view taken along a line IV-IV in FIG. 1B when a scanner casing of the multifunction device is positioned at a third position.
FIG. 4B is a partial enlarged view of a portion encircled by a dotted line in FIG. 4A when the scanner casing is positioned at the third position.
Figure 5B:
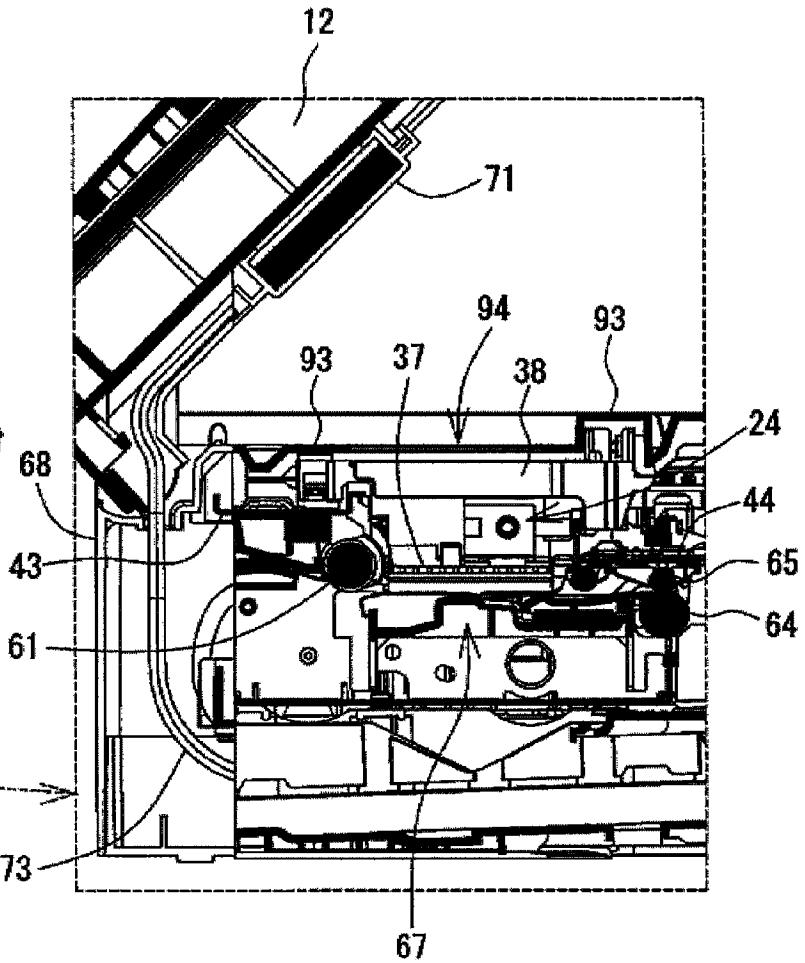
FIG. 5B is a partial enlarged view of a portion encircled by a dotted line in FIG. 5A when the scanner casing is positioned at the fourth position.
Figure 6B:
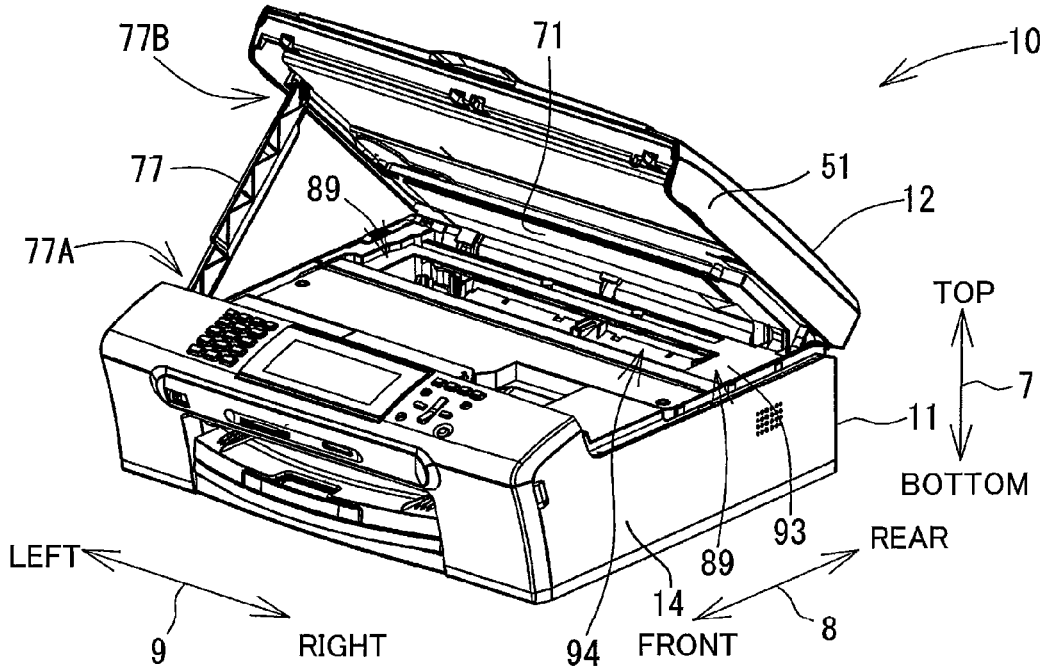
FIG. 6B is a perspective view of the multifunction device when the scanner casing is positioned at the fourth position and the waste liquid chamber is positioned at a second position.

As shown in FIG. 6B, the printer casing 14 is formed with a concave portion 89 depressed downward and having a bottom surface serving as the first cover 93, i.e., the first cover 93 is located downward from an upper surface of the printer casing 14 as shown in FIG. 6B. As shown in FIGS. 4B and 5B, the first cover 93 is disposed above the platen 67 and the recording section 24. In the embodiment, the first cover 93 is fixed to the secondary frame 68. Alternatively, the first cover 93 can be integrally formed with the secondary frame 68, or integrally formed with another frame.

As shown in FIGS. 5A, 5B, 6B, and 7, the first cover 93 is of a generally plate shape having a widthwise length in the right-to-left direction 9 and a longitudinal length in the front-to-rear direction 8 each longer than a height in the top-to-bottom direction 7. The first cover 93 is formed with an elongated opening 94 having rectangular shape. The elongated opening 94 is located in confrontation with the platen 67 and locus of the carriage 38. The platen 67 and the recording section 24 are exposed to an outside through the elongated opening 94 upon the pivotal movement of the waste liquid chamber 71 as shown in FIG. 6B. Even if the conveyance of the recording sheet 15 is interrupted and halted due to mechanical interference of the sheet with an internal mechanism in the multifunction device 10, the user can remove the jammed recording sheet 15.

[Pivotal Movement of the Waste Liquid Chamber 71]

As shown in FIGS. 7 and 8, the secondary frame 68 has a right side inner surface provided with a right-side protrusion (not shown) protruding leftward and a left side inner surface provided with a left-side protrusion (not shown) protruding rightward. The right-side protrusion is disposed at an upper rear end portion of the right side inner surface, and the left-side protrusion is disposed at an upper rear end portion of the left side inner surface. The right-side protrusion extends through the through hole 81. A casing-side protrusion 80 is provided on the scanner casing 51 extending through the through hole formed on the left plate 83. Thus, a space is provided between a free end of the casing-side protrusion 80 and a free end of the right side protrusion of the secondary frame 68, so that the pump tube 73 can be positioned at the space.

The waste liquid chamber 71 is pivotally movable about the right-side protrusion of the secondary frame 68 and the casing-side protrusion 80. That is, the support portion of the present invention includes a pivot support portion configured of the secondary frame 68.

Figure 5A:
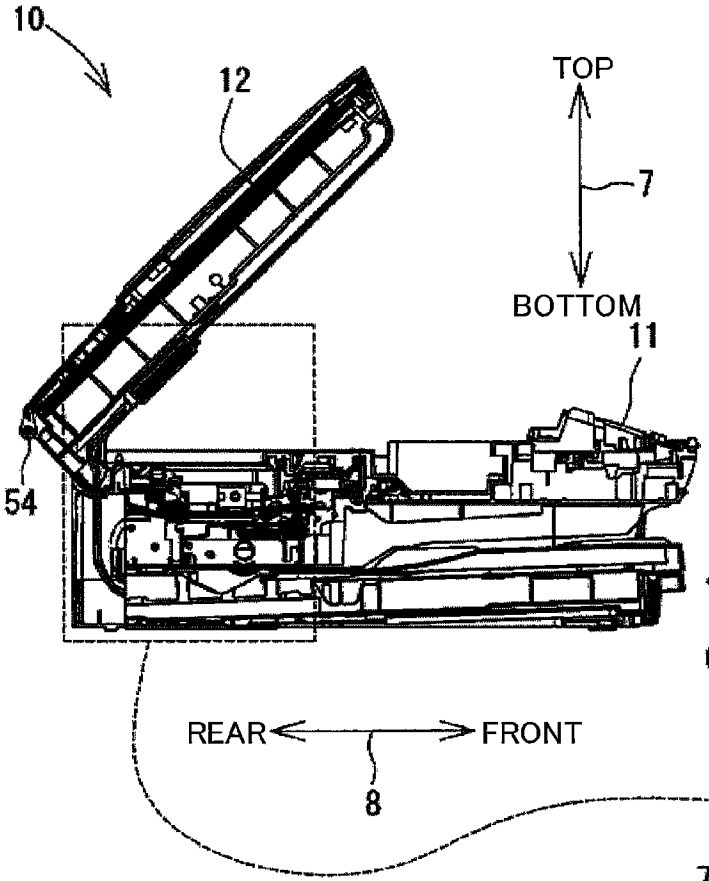
FIG. 5A is a side cross-sectional view taken along the line IV-IV in FIG. 1B when the scanner casing is positioned at a fourth position.

As shown in FIGS. 4A to 6B, the waste liquid chamber 71 is pivotally movable between a first position where the waste liquid chamber 71 is positioned above the platen 67 and the recording section 24 shown in FIGS. 4A, 4B, and 6A, and a second position where the waste liquid chamber 71 moves obliquely upward from the first position shown in FIGS. 5A, 5B, and 6B. The waste liquid chamber 71 pivotably supported on the secondary frame 68 is located immediately above the first cover 93.

As shown in FIGS. 4A, 4B and 6A, the waste liquid chamber 71 is rested on the first cover 93 upon positioning at the first position. Specifically, the waste liquid chamber 71 has a peripheral portion supported on a peripheral part of the elongated opening 94 and a center portion located directly above the elongated opening 94. Thus, the waste liquid chamber 71 is supported by the first cover 93 and the secondary frame 68. The waste liquid chamber 71 positioned at the first position is supported on the first cover 93 so as to be fittingly inserted into the concave portion 89.

As shown in FIGS. 5A, 5B, and 6B, the waste liquid chamber 71 is pivotally moved upward, and is separated from the elongated opening 94. Therefore, in the second position, the elongated opening 94 is exposed to the outside of the printer casing 14. The waste liquid chamber 71 is not supported to the first cover 93 but is supported to the secondary frame 68 when positioning at the second position.

The secondary frame 68 and the first cover 93 permit the waste liquid chamber 71 to cover the elongated opening 94 when the waste liquid chamber 71 is positioned at the first position, and permit the elongated opening 94 to be exposed to the outside when the waste liquid chamber 71 is positioned at the second position.

Since the pump tube 73 is positioned to passes at a position adjacent to the pivotal axis of the waste liquid chamber 71, a length of the pump tube 73 from the pivotal axis to the connector 97 is maintained constant during the pivotal movement of the waste liquid chamber 71. Further, a length of the pump tube 73 from the pivotal axis to the pump 70 is also maintained constant during the pivotal movement, thereby preventing the pump tube 73 from being disconnected from the connector 97 or the pump 70 during the pivotal movement. Providing a longer pump tube 73 on the premise of the disconnection of the pump tube 73 from the connector 97 is not necessary.

In the embodiment, the second position of the waste liquid chamber 71 can be maintained by a locking engagement between the waste liquid chamber 71 and the scanner casing 51 by means of a lock portion 86 described later.

[Pivotal Movement of the Scanner Casing 51]

The scanner casing 51 has a rear end portion provided with the casing-side protrusion 80 protruding rightward and a shaft receiving portion 52 protruding downward. The shaft receiving portion 52 has a right end portion formed with a bore 87 and a left end portion formed with a bore (not shown). The casing-side protrusion 80 is disposed leftward of the bore 87 so as to protrude toward the bore 87. The bore 87, the casing-side protrusion 80, and the bore (not shown) are aligned an identical imaginary axis extending in the right-to-left direction 9.

The right-side protrusion of the secondary frame 68 protruding leftward extends through the bore 87. That is, the right-side protrusion of the secondary frame 68 penetrates the bore 87 and is inserted into the through hole 81 formed on the right plate 82 of the waste liquid chamber 71.

The casing-side protrusion 80 is, as described above, extends through the through hole formed on the left plate 83 of the waste liquid chamber 71. The left-side protrusion of the secondary frame 68 extends through the bore at the left end portion of the shaft receiving portion 52.

The right-side protrusion, the left-side protrusion, and the casing-side protrusion 80 are aligned on the identical imaginary axis extending in the right-to-left direction 9.

With this configuration, the scanner casing 51 is pivotally movable about the right-side protrusion and the left side protrusion as a pivot shaft. The secondary frame 68 supports the waste liquid chamber 71 and the scanner casing 51 such that the waste liquid chamber 71 is pivotally movable about the imaginary axis which is the pivotal axis.

The waste liquid chamber 71 is releasable from the scanner casing 51 unless the waste liquid chamber 71 is locked on the scanner casing 51 by the lock portion 86 described later. That is, although the waste liquid chamber 71 and the scanner casing 51 are pivotally movable about the pivotal axis, the waste liquid chamber 71 pivotally moves independently of the pivotal movement of the scanner casing 51 unless the lock portion 86 locks the waste liquid chamber 71. When the waste liquid chamber 71 is in an unlocked state and the scanner casing 51 is opened (positioned at a fourth position described later) as shown in FIG. 6A, the waste liquid chamber 71 can be positioned at the first position, allowing the ink absorbing member 95 accommodated in the waste liquid chamber 71 to be replaceable.

The scanner casing 51 is pivotably movable between a third position where the scanner casing 51 covers the first cover 93 from above as shown in FIGS. 1A, 4A, and 4B, and the fourth position where the first cover 93 is exposed as shown in FIGS. 5A, 5B, 6A, and 6B.

Figure 1B:
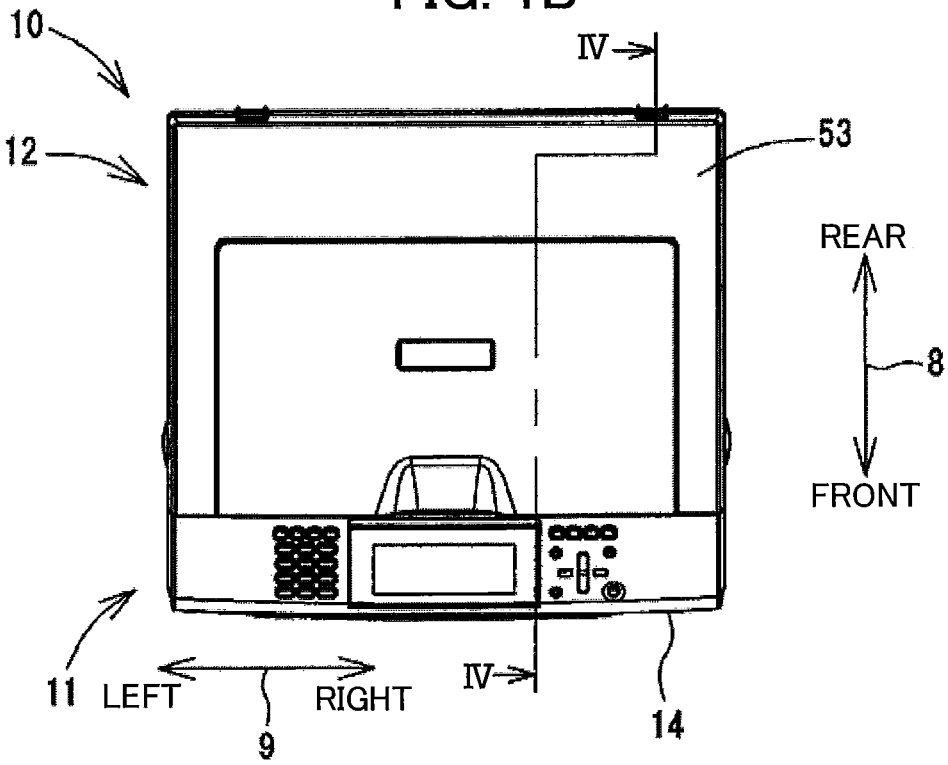
FIG. 1B is a plan view of the multifunction device according to the embodiment.

The scanner casing 51 positioned at the third position is rested on the printer casing 14 so as to be supported on the upper surface of the printer casing 14 as shown in FIG. 1. The first cover 93 is disposed on the upper surface of the printer casing 14. The scanner casing 51 covers the first cover 93 from above upon positioning at the third position.

When the scanner casing 51 is positioned at the fourth position, a front end portion of the scanner casing 51 is supported by a sliding member 77 described later while the rear end portion of the scanner casing 51 is pivotably supported on a rear end portion of the printer casing 14. The sliding member 77 has a front end part 77A pivotably supported on a left front end portion of the printer casing 14, and a rear end part 77B slidably mounted on a left end portion of the scanner casing 51. When the scanner casing 51 is positioned at the third position, the sliding member 77 extends in the front-to-rear direction 8 so that the rear end part 77B is positioned at the rear end portion of the scanner casing 51. The rear end part 77B slidingly moves from the front end portion of the scanner casing 51 to the rear end portion thereof in conjunction with the pivotal movement of the scanner casing 51 from the third position to the fourth position. The sliding member 77 supports the front end portion of the scanner casing 51 when the scanner casing 51 is positioned at the fourth position.

[Lock Portion 86]

As shown in FIG. 7, the scanner casing 51 has a bottom surface provided with two protrusions 98 and 99 whose free end portion is formed with a female-thread. The protrusion 98 is disposed at a position confrontable with the hole 101, and the protrusion 99 is disposed at a position confrontable with the hole 102. When the waste liquid chamber 71 is in abutment with the scanner casing 51, the female-thread of the protrusion 98 and the hole 101 are aligned with each other and the female-thread of the protrusion 99 and the hole 102 are aligned with each other. In the embodiment, screws 103 are threadingly engaged with the female-thread of the protrusion 98 via the hole 101 and the female-thread of the protrusion 99 via the hole 102, respectively. Each screw 103 is threadingly engaged with each female-thread while the scanner casing 51 is open, i.e., the scanner casing 51 is at the fourth position.

The waste liquid chamber 71 is pivotally movable together with the scanner casing 51 when being locked on the scanner casing 51. Specifically, the waste liquid chamber 71 is positioned at the first position when the scanner casing 51 is positioned at the third position. Upon pivotal movement of the scanner casing 51 from the third position to the fourth position, the waste liquid chamber 71 is brought into the second position from the first position.

The waste liquid chamber 71 is pivotally movable independently from the scanner casing 51 when being unlocked on the scanner casing 51. Specifically, the waste liquid chamber 71 is positioned at the first position so as to be superimposed with the scanner casing 51 and cover the elongated opening 94 when the scanner casing 51 is positioned at the third position. Despite the pivotal movement of the scanner casing 51 from the third position to the fourth position, the waste liquid chamber 71 remains at the first position and the cover 88 of the waste liquid chamber 71 is exposed. In this state, the waste liquid chamber 71 still covers the elongated opening 94. To expose the elongated opening 94, the waste liquid chamber 71 is pivotally moved from the first position to the second position independently of the pivotal movement of the scanner casing 51.

Advantageous Effect

Desirably, no components should be disposed above the platen 67 in order to easily remove the recording sheet 15 jammed at the platen 67. In the embodiment, the waste liquid chamber 71 is disposed at a position above the platen 67 yet capable of facilitating removal of the jammed sheet, thereby effectively utilizing a space in the multifunction device 10 and reducing an installation area of the multifunction device 10. That is, according to the embodiment, the waste liquid chamber 71 is movable. Even if the recording sheet 15 is jammed above the platen 67, the recording sheet 15 can be easily removed by virtue of the movement of the waste liquid chamber 71. More specifically, the waste liquid chamber 71 can be positioned at the first position, effectively utilizing the space in the multifunction device 10. The waste liquid chamber 71 can be positioned at the second position, allowing the recording sheet 15 jammed above the platen 67 to be easily removed.

According to the embodiment, since the waste liquid chamber 71 is pivotable, the position of the waste liquid chamber 71 can be easily changed between the first and second positions.

According to the embodiment, the waste liquid chamber 71 is pivotally movable independently of the movement of the scanner casing 51. That is, the pivotal movement of the scanner casing 51 does not lead to pivotal movement of the waste liquid chamber 71, reducing useless pivotal movement of the waste liquid chamber 71 and therefore reducing a possibility of the ink leakage from the waste liquid chamber 71.

According to the embodiment, the waste liquid chamber 71 locked by the lock portion 86 is pivotally movable together with the scanner casing 51. In order to remove the recording sheet 15 jammed above the platen 67, only the scanner casing 51 is operated, and respective operation of the scanner casing 51 and the waste liquid chamber 71 is not necessary.

According to the embodiment, the connector 97 leading the pump tube 73 to the ink absorbing member 95 is held on the main body 90 of the waste liquid chamber 71, reducing a possibility of disconnection of the pump tube 73 from the main body 90 due to the pivotal movement of the main body 90.

According to the embodiment, upon pivotally moving the waste liquid chamber 71, a moving amount of the pivotal axis of the waste liquid chamber 71 is much lower than any other region away from the pivotal axis. In the embodiment, the pump tube 73 passes at a position adjacent to the pivotal axis, thereby reducing a possibility of disconnection of the pump tube 73 from the main body 90 upon the pivotal movement.

According to the embodiment, the waste liquid chamber 71 is disposed above the platen 67 on which the recording sheet 15 is supported during printing operation. The ink may adhere to the waste liquid chamber 71 during the printing operation. However, since the waste liquid chamber 71 is painted with black, or other deep color, a pollution of the ink adhering to the waste liquid chamber 71 is unnoticeable.

Modification

In the above-described embodiment, although the waste liquid chamber 71 is pivotally movable together with the scanner casing 51, the waste liquid chamber 71 can be pivotally moved independently of the scanner casing 51 without the lock portion 86. In this case, a pivotal axis of the waste liquid chamber 71 may be different from that of the scanner casing 51. Further, a pivoting direction of the waste liquid chamber 71 may be different from that of the scanner casing 51. For example, the scanner casing 51 may be pivotable about a rear end portion thereof, while the waste liquid chamber 71 may be pivotable about a front end portion thereof. Further, the waste liquid chamber 71 may be not pivotable but slidable or removable from the elongated opening 94.

In the above-described embodiment, although the pump tube 73 passes through the pivotal axis, the pump tube 73 may not pass therethrough. In the latter, the pump tube 73 should have a sufficient length for avoiding disconnection from the connector 97.

While the invention has been described in detail with reference to the embodiment thereof, it would be apparent to those skilled in the art that various changes and modifications may be made therein without departing from the spirit of the invention.

What is claimed is:

1. An inkjet recording device comprising:

a main body comprising:

a recording head configured to eject ink onto a recording medium to record an image; and a pump configured to draw the ink from the recording head; and a movable unit configured to move between a near position and a far position which is away from the near position with respect to the main body, the movable unit comprising a waste liquid chamber configured to accommodate the ink drawn by the pump, wherein the main body further comprises a support configured to movably support the waste liquid chamber, and wherein the waste liquid chamber is selectively positioned between a closed position where the waste liquid chamber is positioned above the recording head and a remote position where the waste liquid chamber is positioned away from the closed position.

2. The inkjet recording device according to claim 1, wherein the main body further comprises a platen configured to support the recording medium and disposed below the recording head in confrontation therewith, the waste liquid chamber being positioned above the platen at the closed position.

3. The inkjet recording device according to claim 2, wherein the support further comprises a cover disposed above the recording head and formed with an opening exposing the recording head to an outside, wherein the support is configured to dispose the waste liquid chamber above the cover such that the waste liquid chamber covers the opening at the closed position and the waste liquid chamber exposes the opening at the remote position.

4. The inkjet recording device according to claim 2, wherein the support comprises a pivot support portion configured to pivotally move the waste liquid chamber between the closed position and the remote position.

5. The inkjet recording device according to claim 3, wherein the movable unit covers the cover from above at the near position and the movable unit exposes the cover to an outside at the far position, wherein the movement of the movable unit is independently of the movement of the cover.

6. The inkjet recording device according to claim 1, wherein the waste liquid chamber further comprises:

an ink absorbing member configured to absorb the ink drawn by the pump;

a tube configured to provide a fluid communication from the pump to the ink absorbing member;

a connector configured to connect the tube to the ink absorbing member; and a casing configured to integrally support the ink absorbing member and the connector, the casing and the movable unit being pivotally movable about an identical pivotal axis.

7. The inkjet recording device according to claim 6, wherein the waste liquid chamber further comprises a piping unit configured to direct the tube such that the tube passes at a position adjacent to the pivotal axis.

8. The inkjet recording device according to claim 1, wherein the movable unit further comprises a scanner configured to scan documents.

* * * * *